US009360028B2

(12) United States Patent
Zwingler et al.

(10) Patent No.: US 9,360,028 B2
(45) Date of Patent: Jun. 7, 2016

(54) HYDRAULIC DRIVE AND HYDRAULICALLY OPERABLE WORKING TOOL

(71) Applicant: HAWE HYDRAULIK SE, Munich (DE)

(72) Inventors: Engelbert Zwingler, Baiern/Antholing (DE); Georg Aneder, Emmering (DE)

(73) Assignee: HAWE HYDRAULIK SE (DE)

( * ) Notice: Subject to any disclaimer, the term of this patent is extended or adjusted under 35 U.S.C. 154(b) by 573 days.

(21) Appl. No.: 13/845,583

(22) Filed: Mar. 18, 2013

(65) Prior Publication Data

US 2014/0083085 A1 Mar. 27, 2014

(30) Foreign Application Priority Data

Sep. 21, 2012 (EP) ..... 12185472

(51) Int. Cl.
*F15B 13/04* (2006.01)
*F15B 15/20* (2006.01)
*F15B 11/042* (2006.01)

(52) U.S. Cl.
CPC ..... *F15B 15/20* (2013.01); *F15B 11/0423* (2013.01); *F15B 2211/50536* (2013.01)

(58) Field of Classification Search
CPC ..... F15B 15/20; F15B 11/0423; F15B 2211/50536; F15B 2015/268
USPC ..... 137/115.03; 91/442
See application file for complete search history.

(56) References Cited

U.S. PATENT DOCUMENTS 5,076,140 A * 12/1991 Nelsen ..... F16F 15/027 60/461
7,296,669 B2 * 11/2007 Quehenberger ..... F16D 48/02 192/85.63
8,549,983 B2 * 10/2013 Brahmer ..... B30B 15/16 91/420
2003/0178060 A1 * 9/2003 Hoffmann ..... F15B 11/044 137/115.03
2011/0088797 A1 * 4/2011 Nishioka ..... A01D 34/74 137/565.14
2012/0090690 A1 * 4/2012 Andersson ..... B66C 13/18 137/12

OTHER PUBLICATIONS

European Search Report Dated May 8, 2013, Application No. 12185472.3-1751, Applicant HAWE Hydraulik SE, 7 Pages.

* cited by examiner

*Primary Examiner* — Nathaniel Wiehe
*Assistant Examiner* — Dustin T Nguyen
(74) *Attorney, Agent, or Firm* — Brooks Kushman P.C.

(57) ABSTRACT

A hydraulic control, for example of a hydraulically operable working tool, includes a hydroconsumer that can be acted upon against a permanent force via a pressure source, and a switching valve with working power/pressure control function reacting against a spring force depending on a pressure and/or through flow volume. The switching valve connects the hydroconsumer with a tank for a return stroke of the hydroconsumer when the pressure source is switched off. The hydroconsumer can be hydraulically stopped with the return stroke via the pressure source by a pressure pulse and/or through flow volume pulse. In a hydraulically operable working tool, the hydroconsumer can be hydraulically stopped in the return stroke even before a predetermined end position is reached by switching on the pressure source.

18 Claims, 3 Drawing Sheets

2
39
22(30)
42
18,19,20,21
38
27
9a
33
29
23,24,29
30
9b
35
T
P
U
10,10a
A
26
38(15)

HYDRAULIC DRIVE AND HYDRAULICALLY OPERABLE WORKING TOOL

CROSS-REFERENCE TO RELATED APPLICATIONS

This application claims foreign priority benefits under 35 U.S.C. §119(a)-(d) to European patent application number EP 12185472.3, filed Sep. 21, 2012, which is incorporated by reference in its entirety.

TECHNICAL FIELD

The disclosure relates to a hydraulic drive and to a hydraulically operable working tool.

BACKGROUND

In a portable, hydraulically operable tool (with accumulator or mains cable) that can be used, for example, as cable lug press, a well-known hydraulic drive is used whose switching valve with working power/pressure control function (the latter by an integrated pressure control valve) is disposed in a discharge channel to the tank which branches off from a working line from the pressure source to the hydroconsumer. When the tool is started for the first time, the working power is limited by opening the pressure control valve via the pressure control function when a working position is reached. The pressure control valve then remains in its open position, so that, after the pressure source has been switched off, the permanently acting force (either a spring or a load) will move the hydroconsumer via its return stroke to a predetermined end position and in the process allow the pressurizing agent to flow off from the admission chamber to the tank through the switching valve which is in the passage position. Then, the pressure control valve returns to its original position. Since the switching valve also controls the pressure control function, it needs a high spring force and a relatively narrow throttle point, which on the one hand requires at least one very large pressure admission surface, and on the other hand results in a relatively limited return stroke speed. The hydroconsumer will always drive back to its end position over the complete return stroke, even if the pressure source is switched on again during the return stroke. The return stroke could only be manually stopped by actuating a manual emergency device. However, this requires complicated hand movements and a considerable expenditure of force. Since the hydroconsumer always performs the complete return stroke, a lot of time is wasted until the next operation, also due to the slow return stroke speed. For in many applications, it would be sufficient, for example when cable lugs are pressed, to only slightly release the tool application controlled by the hydroconsumer until it can be transferred to a new working position without having to accept the long duration for the return stroke. The large pressure admission surface in the switching valve results in high structural efforts. Furthermore, a relatively high permanent force (energy storing spring) for the hydroconsumer is required.

It has been suggested in practice to additionally dispose an electrically operable valve in the hydraulic drive of such a tool by which the return stroke of the hydroconsumer can be stopped at any arbitrary point before the hydroconsumer has reached its end position. However, this involves additional, cost-intensive efforts and an extra demand of electric energy, being a disadvantage, for example, in a tool powered by an accumulator. Moreover, an electric activation of the valve is required, and also a separate actuator for the valve, thus rendering the handling of the tool difficult and creating additional sources of failure.

SUMMARY

An object underlying the disclosure is to provide a hydraulic drive of the type mentioned in the beginning and a hydraulically operable working tool, where one does not have to await the duration of the complete return stroke of the hydroconsumer to its end position after a working cycle, and this in an energy-saving manner and without any additional components of equipment.

The hydroconsumer can be stopped at an arbitrary point during the return stroke before it reaches its end position just by generating a pressure and/or volume flow pulse via the pressure source, and it can either be held at this position or immediately be brought again to a working position by the switched-on pressure source, so that, if this is desired, the duration for the complete return stroke and the new stroke towards the working position, at least to the stop position, does not have to be awaited. An essential advantage of the hydraulic control is that components needed for the normally required functions are employed for stopping the return stroke, and no additional pieces of equipment are required.

The possibility of stopping the return stroke at any arbitrary position, of holding this position, or of immediately initiating a new working cycle offers the considerable advantage of a clear saving of time with several subsequent working cycles in the hydraulically operated working tool.

In a suitable embodiment, the pressure source is a pump that can be electrically operated in the cutoff operation (accumulator operation or mains cable operation), and the pressure or volume flow pulse required for hydraulically stopping the return stroke can be generated by at least temporarily switching on the initially switched off pump. This can be comfortably done by the user via the on-off switch of the pump which is provided anyway.

In the hydraulic drive, the switching valve and its working power/pressure control function are suitably connected in parallel in a working line extending from the pressure source via the hydroconsumer and the throttle point to the tank, and the working line is guided through the switching valve both to the hydroconsumer and from the hydroconsumer to the tank in each case. This represents a suitable departure from the common principle of disposing the switching valve only in the outlet line to the tank and provides a prerequisite for stopping the return stroke at any time only by hydraulic means.

Advantageously, the working line is here equipped with a control throttle arrangement between the pressure source and the hydroconsumer generating a predetermined pressure differential from the delivery pressure or the delivery rate of the pressure source, comprising either a control throttle and a check valve shutting off in the return flow direction to the pressure source, or only a spring-loaded check valve with control throttle function shutting off in the return flow direction to the pressure source. The spring force of the switching valve acts in the moving direction towards the passage position, while the switching valve is pilot controlled by pressure in the moving direction towards the shutoff position from upstream of the control throttle arrangement, and additionally in the moving direction towards the passage position from downstream of the control throttle arrangement each. These pressure pilot controls of the switching valve permit to provide the usual functions of such a hydraulic drive and to additionally stop the return stroke at any desired point.

Here, it might be important for the switching valve to hold the shutoff position by pressure pilot control during the extending motion of the hydroconsumer and in the respective working position against the spring force.

In a preferred embodiment, the switching valve comprises, for the shutoff position between the hydroconsumer and the tank, a seat and a seat valve closing member with a sealing surface, preferably between the throttle point disposed at the inlet of the switching valve and a tank connection. The seat valve closing member shuts off at the seat under the delivery pressure or delivery rate of the pressure source, and it is lifted off the seat without delivery pressure or delivery rate by the spring force of the switching valve when the manual emergency control is used or pressure control is effected. This is because in this case, the pressure in the chamber collapses. If this is not the case, the seat valve closing member will remain on the seat due to the pressure caused by the force permanently acting in the hydroconsumer. The changeovers of the switching valve are done quickly without delay.

In a suitable embodiment, there are provided in a housing of the switching valve for the working power/pressure control function in the seat valve closing member a through bore in communication with the pressure source, a piston loaded by the spring force of the switching valve with a closing projection cooperating with the through bore, and preferably an adjustable abutment for a spring generating the spring force. Here, the abutment can be either disposed in the seat valve closing member, for example fixed by being bolted, and be movably guided in the housing with the seat valve closing member being sealed against the outside of the housing, or the abutment is disposed in the housing separate from the seat valve closing member, for example bolted, the seat valve closing member being encapsulated in the housing in a sealed manner. The latter solution has the advantage of requiring fewer sealing zones which are subjected to stress in the operation of the switching valve.

To permit a manual emergency stop control, for example for venting the system or relieving it from pressure or the like, it is suitable for a projection to extend from the piston through the abutment to the outside of the housing in a sealed manner, the projection forming a manual emergency actuation at the end situated outside the housing.

In an advantageous embodiment, a chamber with a pressure source connection is disposed underneath the seat valve closing member in the housing which is partially limited by a chamber bottom facing away from the seat valve closing member. The chamber bottom can be embodied as an insertion part inserted in the housing or be an integral part of the housing. The chamber bottom is penetrated by a passage leading to a hydroconsumer connection point of the housing. The control throttle arrangement is disposed in the passage, for example. This results in short and low-loss flow paths and a compact construction of the switching valve.

In the passage of the chamber bottom, the control throttle embodied as screwed throttle insert, and the check valve embodied as plate-type check valve are mounted. The screwed throttle insert can be easily replaced by one embodied with a different throttle cross-section. The plate-type check valve saves installation space in the axial direction. As an alternative, the spring-loaded check valve with control throttle function can be mounted directly in the passage.

To ensure smooth-running and neat movements of the movable components of the switching valve, the piston for the pressure control function can be guided inside the seat valve closing member embodied as piston tube with a conical sealing surface on the outer periphery, and the seat valve closing member can be movably guided inside a bushing inserted in the chamber of the housing.

As peripheral equipment, a pump on-off switch can be provided to which preferably either a time function element or a program section is functionally allocated to switch on the pump for stopping the return stroke of the hydroconsumer for a predetermined duration which ensures that the pressure or volume flow pulse is sufficient for switching over the switching valve from the passage position to the shutoff position and holding it in the shutoff position via a corresponding pressure differential at the control throttle arrangement.

Embodiments of the subject matter of the disclosure will be illustrated in more detail with reference to the below drawings.

DETAILED DESCRIPTION

As required, detailed embodiments are disclosed herein. However, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

Figure 1:
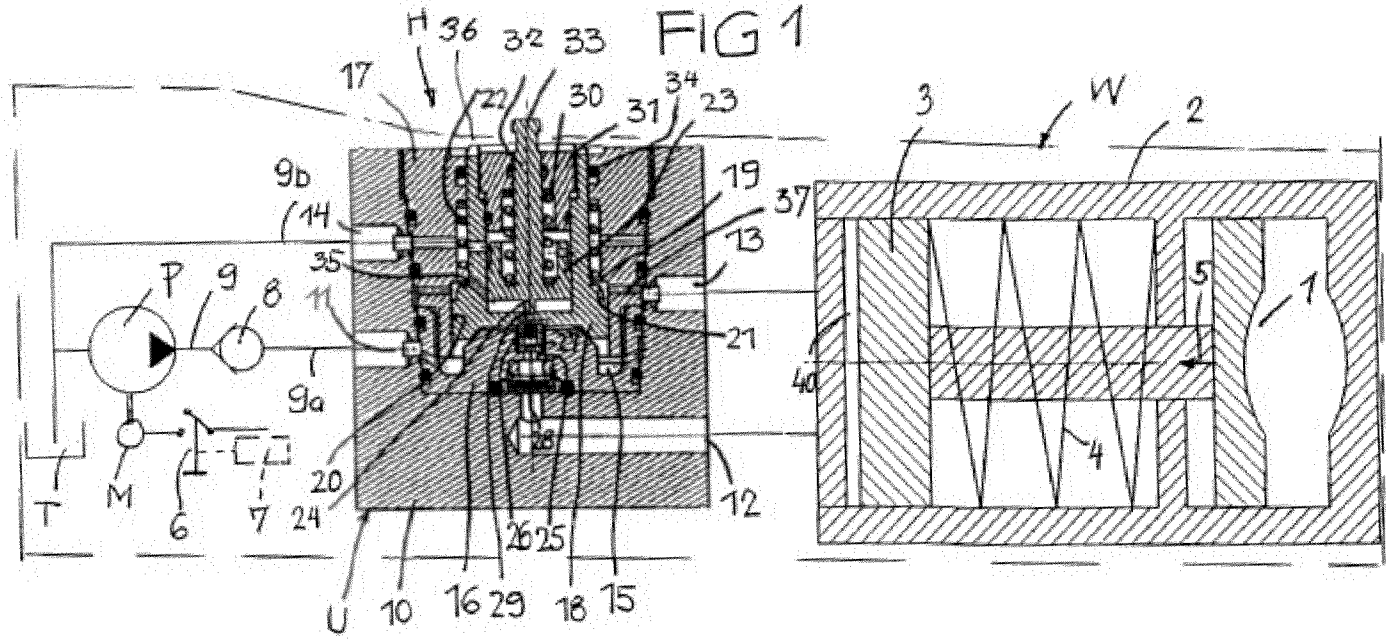
FIG. 1 shows a block diagram, partially in a section, of a first embodiment of a hydraulic drive control in a hydraulically operable working tool indicated as non-restricting example.

FIG. 1 shows a hydraulic drive H which is integrated in a hydraulically operable working tool W by way of example without being restricted to this, and which is shown in a depressurized state. The tool W can be a portable tool, for example for pressing cable lugs, a cutting tool, such as accident scissors, or a rotary tool, for example to be employed in the field, and comprises a suitably exchangeable tool insert 1 which is controlled by a hydroconsumer 2, in the shown embodiment by a hydraulic cylinder with a single-actuated piston 3 hydraulically movable from one side against a permanent force (energy storing spring 4 or a load 5).

In the tool W, a pressure source P is provided at a tank T and can be operated by an electric motor M in the cutoff operation. This can be a fixed displacement pump with one or several pump elements. The electric motor M is connected to an on-off switch 6 which can be actuated at the tool as required. In an optional embodiment, a time function element or a program section 7 is allocated to the on-off switch and ensures, when the on-off switch 6 is only temporarily actuated for switching on, a predetermined switch-on period which will be discussed later.

A working line 9 leads from the pressure source P to the hydroconsumer 2 via a check valve 8 shutting off in the return flow direction to the pressure source P, namely one branch 9*a* of the working line 9 through a switching valve U with working power/pressure control function to an admission chamber 40 of the hydroconsumer 2, and one branch 9*b* from the admission chamber 40 through the switching valve U to the tank.

The switching valve U comprises a housing 10, in the embodiment shown in FIG. 1 in a block form or as a screwed-in cartridge, e.g., of steel, which comprises a pressure source connection 11, a hydroconsumer connection 12, another hydroconsumer connection 13, and a tank connection 14 within a certain connection diagram. In the housing 10, a chamber 15 communicating with the pressure source connection 11 is formed and limited by a chamber bottom 16, a bushing 17 screwed into the housing 10, and a seat valve closing member 18 embodied as a piston tube. The chamber bottom 16 is optionally embodied as insertion part (as shown), but it can also be embodied to be integrally formed with the housing 10. The bushing 17 guides the seat valve member 18 in a cylindrical guiding zone 20 and comprises a seat 19 embodied as surrounding edge for an external conical sealing surface 21 of the seat valve closing member 18 which is located between the second hydroconsumer connection 13 and the tank connection 14. The seat valve member 18 is acted upon in the direction lifting it from the seat 19 by a relatively weak spring 22 with a spring force. The spring 22 can optionally also be omitted.

Inside the seat valve member 18, a piston 23 is movably guided and provided for the tool working force/pressure control function of the switching valve U and supports a closing member projection 24 at its bottom side which cooperates with a passage 29 in the bottom of the seat valve member 18 (pressure control seat valve function). The chamber bottom 16 contains a passage to the first hydroconsumer connection 12. In the passage, a control throttle arrangement A is disposed which consists of a screwed-in throttle insert 26 with a control throttle 27 of a predetermined cross-sectional dimension in the embodiment of FIG. 1 and also comprises a check valve 28 shutting off in the return flow direction towards the pressure source connection 11 and embodied as a plate-type check valve having small dimensions in the axial direction in the shown embodiment.

A spring 30 is disposed inside the piston 23 which generates the spring force for keeping the pressure control valve 24, 29 closed. The spring 30 is supported with its other end at an abutment 31 which is screwed into the seat valve member 18 and permits to change the spring force in the embodiment in FIG. 1. The piston 23 comprises a centric projection 32 which extends through the spring abutment 31 to the outside out of the housing 10 in a sealing manner and forms a manual emergency control 33 outside the housing. The seat valve member 18 extends through a seal 34 in the sleeve 17 to the outside out of the housing, where structures 36 can be shaped which permit a rotary support when the abutment 31 is being screwed. In case of clearances of the seat valve closing member 18, its end 36 will move at the upper outer side of the housing 10, the abutment 31 taking up these movements. Furthermore, an oblique passageway 35 is bored into the seat valve closing member 18 and provides a flow communication from the passage 29 to the tank connection 14 or from the interior of the seat valve closing member 18 to the annular space where the optionally provided spring 22 is accommodated. A bore 37 is provided between the second hydroconsumer connection 13 and an annular space at the sealing surface 21 of the seat valve closing member 18 and could form a throttle point if the return stroke speed is to be limited.

Figure 2:
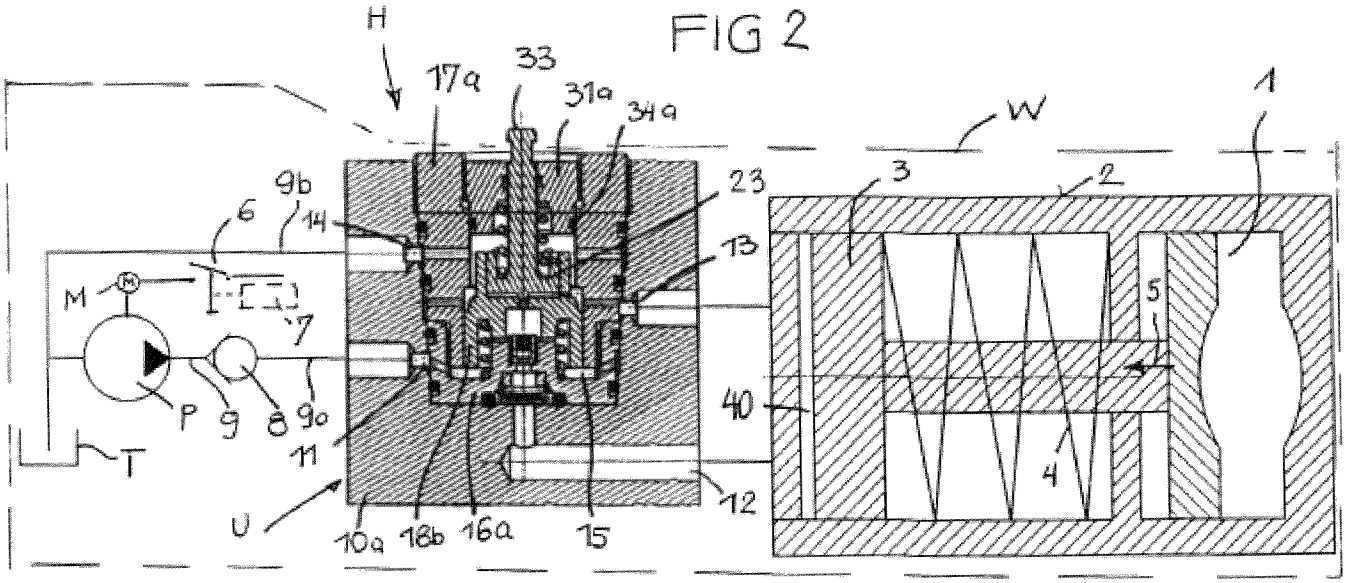
FIG. 2 shows a representation similar to that of FIG. 1 of a second embodiment of the hydraulic drive.

The embodiment of the hydraulic drive H in FIG. 2 differs from that of FIG. 1 in that, with the same connection diagram of the housing 10*a*, the abutment 31*a* is bolted in the bushing 17*a* and structurally separated from the piston 23. The seat valve closing member 18*a* is shorter than in FIG. 1. Only the spring 30 is provided, while the spring 22 shown in FIG. 1 is omitted, so that the spring 30 also acts on the seat valve closing member 18*a* to move it away from the seat when the pressure control valve is closed. The chamber bottom 16*a* has a cross-section different from that of FIG. 1 which saves installation space. The function of the hydraulic drive which will be illustrated below is identical in both embodiments of FIGS. 1 and 2. Furthermore, in both embodiments, the control throttle arrangement A can be replaced by only one (non-depicted) spring-loaded check valve 25 with control throttle function e.g., in the passage 25 which shuts off in the return flow direction to the pressure source connection 11. Furthermore, the control throttle arrangement A could alternatively be placed at a different point in the housing 10, 10*a*, or directly in the hydroconsumer connection 12.

Figures 3, 4, 5:
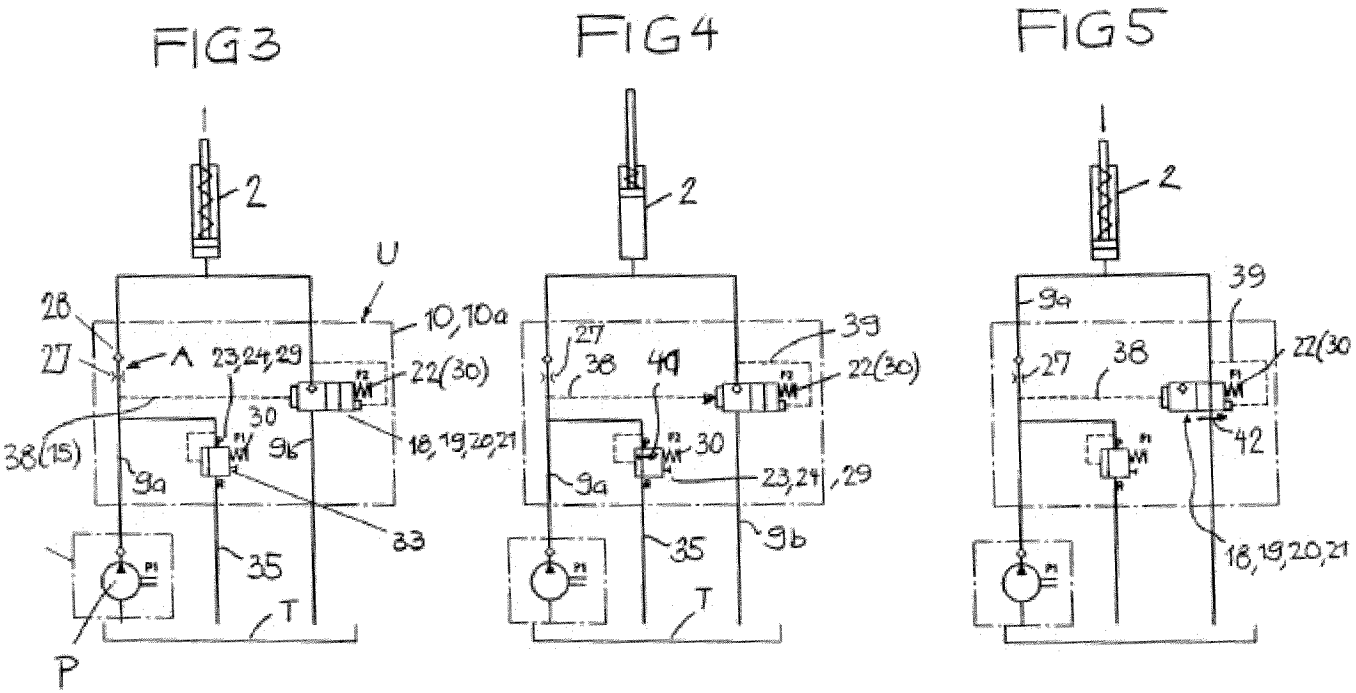
FIG. 3 shows a block diagram with the hydraulic drive while the tool is being started.
FIG. 4 shows a block diagram including the hydraulic drive in a working phase.
FIG. 5 shows a block diagram including the hydraulic drive when it is put out of operation, where in FIGS. 3, 4, 5 the components of the hydraulic drive are represented with hydraulic symbols.

In FIG. 3, the switching valve U with its housing 10, 10*a* indicated in a dot-dash line is represented such that the switching valve function (components 19, 20, 21) and the pressure control function (components 23, 24, 28), and the respective spring force 22, 30 are shown to be separate, such that in branches 9*a*, 9*b* of the working line 9, the switching valve function and the pressure control function are connected in parallel. For the pressure pilot control in the switching valve function of the components 19, 20, 21 and 22 (30) in the branch 9*b* of the working line, pilot control lines 18 and 39 are indicated in a dot-dash line which are formed in FIGS. 1 and 2 on the one hand by the chamber 15 and on the other hand by the throttle point 37. The pilot control line 38 leads from upstream of the control throttle arrangement A to the closing control side of the seat valve closing member 18, while the pilot control line 39 leads from downstream of the control throttle arrangement A to the opening control side of the seat valve member 18.

In the phase shown in FIG. 3, the starting is done, i.e., the pressure source P is switched on. The banking-up pressure arising from the delivery pressure or delivery rate of the pressure source P generates a pressure differential between the pilot control lines 38, 39 at the control throttle 27, whereby the seat valve closing member 18 goes into its leakage-free shutoff position, i.e., comes to lie closely against the seat 19 with the sealing surface 21. The throttle point 37 is thereby separated from the tank connection 14 (shutoff position). By the spring force 30, the piston 23 holds the passage 29 closed via the closing projection 24, so that the connecting channel 35 to the tank is shut off. The hydroconsumer 2 is driving out with an extending motion. If the pressure source is switched off again before the maximal working pressure desired by the pressure control function is reached, the pressure in the admission chamber 40 built up by the permanent force 4; 5 keeps the switching valve in the shutoff position. The hydroconsumer remains in the current position. If in this operating stage, the manual emergency control 33 is used, the built up pressure is removed via the connecting channel 35 in the seat valve closing member 18 to the tank, and the switching valve U assumes its (not shown) passage position via the pressure pilot control from the pilot control line 39, whereupon the hydroconsumer 2 performs a return stroke to the end position under the permanently acting force 4; 5.

FIG. 4 illustrates the working stage of the hydraulic drive H. The hydroconsumer 2 is extended to a working position of the tool insert 1. The pressure source P generates the required working pressure. When the desired maximal working pressure is reached (arrow 41), the pressure control valve with its components 23, 24, 29 is actuated against the spring force 30. The pressure control valve remains opened until the pressure in the chamber 15 has dropped to such an extent that the switching valve U switches over. Then, the pressure control valve closes again.

FIG. 5 illustrates the decommissioning of the hydraulic drive H by switching off the pressure source P. Since then only the pressure in the admission room 40, caused by the permanent force 4, 5, is acting via the pilot control line 39, as also the spring 22 (or a portion of the spring force of the spring 30), the seat valve closing member 18 is, as is shown, lifted from the seat 19 to the passage position, and the hydroconsumer 2 performs its return stroke to its predetermined end position at a speed which is optionally predetermined by the bore 37. If it is desired to stop the hydroconsumer 2 during the return stroke at an arbitrary point, that means to stop the return stroke, the pressure source P will be switched on again still during the return stroke in FIG. 5 until the necessary banking-up pressure is formed at the control throttle 27 by means of a pressure and/or volume flow pulse which brings the seat valve member 18 (arrow 42) again to its shutoff position. If the pressure source is only temporarily switched on for the duration mentioned in the beginning and then switched off again, the hydroconsumer will stop and remain at the stopped position. If, however, the pressure source P still remains switched on, the hydro consumer 2 will extend again into a working position in which the maximum pressure optionally acts, while the seat valve closing member 18 holds its shutoff position.

If, after the maximum pressure is reached (max. working power), the pressure source P is switched off, the hydroconsumer 2 will perform its complete return stroke which can be stopped again at any time by switching the pressure source on again.

In FIG. 1, when the pressure source P (the electric motor M) is switched on, a pressure differential is generated from the volume flow at the control throttle 27, while the admission chamber 40 is getting under pressure, so that the seat valve closing member 18 drives with its sealing surface 21 against the seat 19 and assumes the shutoff position. This will shut off the branch 9*b*, and the hydroconsumer 2 will extend. The closing projection 24 keeps the passage 29 shut off; the piston 23 performs the movement of the seat valve closing member 18, together with the abutment 31 in FIG. 1. If in the working position, the working power/pressure control function is activated, the closing projection 24 lifts from the passage 29, and pressurizing agent will flow from the chamber 15 through the passage 29 and the connecting channel 35 to the tank connection 14, where optionally the check valve 28 shuts off. In the process, the piston 23 temporarily moves upwards against the spring force 30 relative to the seat valve closing member 18. The connection from the throttle point 37 to the tank connection 14 is shut off. If now the pressure source P (the electric motor M) is switched off, the pressure differential decreases via the control throttle 27, and the seat valve closing member 18 is shifted to the position shown in FIG. 1 and lifted from the seat 19 together with the piston 23 at least by the spring force 30 and the pressure acting via the throttle point 37 in the admission chamber 40. Since now the throttle point 37 is connected with the tank connection 14, the permanent force 4; 5 presses the pressurizing agent out of the admission chamber 40 into the tank T, either until the hydroconsumer 2 has performed its complete return stroke to the end position or until the pressure source P is switched on again to stop the return stroke by a pressure pulse and/or a through flow volume pulse and optionally initiate a new extending motion.

To be able to easily adapt the hydraulic drive H to the respective demands (for example with respect to performance, direction of motion, stroke, etc.), the hydroconsumer 2 (hydraulic cylinder, hydraulic motor) is optionally disposed such that it can be easily replaced, i.e., the hydroconsumer connections in the housing 10, 10*a* of the switching valve U form interfaces for combinations with different types of hydroconsumer 2. For example, the switching valve U can be matched to changing demands by exchanging the throttle insert 26 and/or adjusting the abutment 31 to change the spring force 30 (22). The switching valve U is illustrated with a block-like housing 10, 10*a*, however it could alternatively be a valve cartridge or a screwed-in valve. The check valve 28 could be arranged in the system at another position than the one shown.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A hydraulic drive comprising:

a pressure source;

a tank;

at least one single-actuated hydroconsumer that is actuatable from the pressure source to execute an extending motion into a working position counter to a permanent force; and a switching valve having a working force/pressure control function, the switching valve being configured to respond counter to spring force and depending on pressure and/or through flow volume, and the switching valve being operable to take a through flow position when the pressure source is cut off or switched off and to connect an admission chamber of the hydroconsumer at least via a bore with the tank for a return stroke of the hydroconsumer under the permanent force;

wherein the hydroconsumer is stoppable during the return stroke hydraulically via the pressure source by a pressure pulse and/or a through flow volume pulse; and wherein the switching valve comprises a seat and a seat valve closing member with a sealing surface between the hydroconsumer and the tank, and further comprises, in a housing for the working force/pressure control function in the seat valve closing member, a through bore in communication with the pressure source, a piston loaded by the spring force of the switching valve with a closing projection that cooperates with the through bore, and an adjustable abutment for a spring generating at least a portion of the spring force, and wherein either the abutment is disposed in the seat valve closing member and movably guided in the housing with the seat valve closing member sealed to the outside in the housing, or the abutment is disposed directly in the housing separate from the seat valve closing member encapsulated in the housing in a sealing manner.

2. The hydraulic drive according to claim 1 wherein the pressure source is a pump that can be electrically operated in a cutoff operation, and the pressure pulse and/or the through flow volume pulse can be generated by at least temporarily switching on the switched off pump for a predetermined time duration.

3. The hydraulic drive according to claim 1 wherein a switching valve function of the switching valve and the working force/pressure control function are connected in parallel in a working line extending from the pressure source via the hydroconsumer and the bore to the tank, and a portion of the working line from the pressure source to the hydroconsumer and a portion of the working line from the hydroconsumer to the tank each extend through the switching valve.

4. The hydraulic drive according to claim 3 wherein the working line comprises, between the pressure source and the hydroconsumer, a control throttle arrangement that is configured to generate a pressure differential from hydraulic delivery pressure or delivery rate generated by the pressure source, the control throttle arrangement comprising either a control throttle and a check valve configured to shut off in a return flow direction to the pressure source, or only a spring-loaded check valve with control throttle function configured to shut off in the return flow direction to the pressure source, and wherein the spring force of the switching valve is configured to act in a first moving direction of the switching valve to the through flow position, and the switching valve is configured to be pilot controlled by pressure each in a second moving direction towards a shutoff position from upstream of the control throttle arrangement, and in the first moving direction towards the through flow position from downstream of the control throttle arrangement.

5. The hydraulic drive according to claim 4 wherein the seat and the seat valve closing member with the sealing surface are for the shutoff position, and the switching valve further comprises a tank connection, and wherein the seat valve closing member is configured to shut off under the delivery pressure or delivery rate of the pressure source at the seat and is, without delivery pressure or delivery rate, configured to be lifted off the seat by the spring force of the switching valve.

6. The hydraulic drive according to claim 5 wherein the switching valve comprises a chamber underneath the seat valve closing member and having a pressure source connection, and wherein the chamber is limited on a side facing away from the seat valve closing member by a chamber bottom embodied as an insertion part that is penetrated by a passage leading to a hydroconsumer connection, and the control throttle arrangement is disposed in the passage.

7. The hydraulic drive according to claim 6 wherein, in the passage, either the control throttle embodied as a screwed-in throttle insert, and the check valve embodied as a plate-type check valve are mounted, or the spring-loaded check valve with control throttle function is mounted.

8. The hydraulic drive according to claim 4 wherein the pressure source comprises a pump, and the hydraulic drive further comprises a pump on-off switch, and either a time function element or a program section that is functionally allocated to the pump on-off switch to switch on the pump for stopping the return stroke of the hydroconsumer over a predetermined time duration which ensures that the pressure pulse and/or through flow volume pulse is sufficient for switching the switching valve from the through flow position to the shutoff position and holding the switching valve in the shutoff position via a pressure differential generated at the control throttle arrangement.

9. The hydraulic drive according to claim 1 further comprising a projection that extends from the piston through the abutment to the outside of the housing in a sealed manner, and an external end of the projection forms a manual emergency control at least for pressure relief and/or venting.

10. The hydraulic drive according to claim 1 wherein the piston is movably guided inside the seat valve closing member embodied as a piston tube with a conical sealing surface on an outer periphery, and the seat valve closing member is movably guided inside a bushing inserted in the housing.

11. A hydraulically operable working tool comprising:

a tool insert;

a hydroconsumer for controlling the tool insert and that can be hydraulically acted upon against a permanent force, the hydroconsumer having an admission chamber;

a pressure source that can be electrically operated in a cutoff operation; and a switching valve having a working force/pressure control function that is configured to react depending on pressure and/or through flow volume, the switching valve being operable, when the pressure source is switched off, to connect the admission chamber of the hydroconsumer with a tank for a return stroke of the hydroconsumer under the permanent force;

wherein the hydroconsumer is stoppable exclusively hydraulically by a pressure pulse and/or a through flow volume pulse generated by switching on the switched off pressure source during the return stroke before a predetermined end position is reached; and wherein the switching valve comprises a seat, a seat valve closing member with a sealing surface, and a chamber underneath the seat valve closing member and having a pressure source connection, and wherein the chamber is limited on a side facing away from the seat valve closing member by a chamber bottom embodied as an insertion part that is penetrated by a passage leading to a hydroconsumer connection, and wherein a control throttle arrangement is disposed in the passage, the control throttle arrangement being configured to generate a pressure differential from hydraulic delivery pressure or delivery rate generated by the pressure source.

12. The hydraulically operable working tool according to claim 11 wherein the pressure source comprises a pump, and the pressure pulse and/or the through flow volume pulse can be generated by at least temporarily switching on the switched off pump for a predetermined time duration.

13. The hydraulically operable working tool according to claim 11 wherein the hydraulically operable working tool comprises the tank, wherein a switching valve function of the switching valve and the working force/pressure control function are connected in parallel in a working line extending from the pressure source via the hydroconsumer to the tank, and a portion of the working line from the pressure source to the hydroconsumer and a portion of the working line from the hydroconsumer to the tank each extend through the switching valve.

14. The hydraulically operable working tool according to claim 13 wherein the control throttle arrangement comprises either a control throttle and a check valve configured to shut off in a return flow direction to the pressure source, or only a spring-loaded check valve with control throttle function configured to shut off in the return flow direction to the pressure source, and wherein the spring force of the switching valve is configured to act in a moving direction of the switching valve to the through flow position, and the switching valve is configured to be pilot controlled by pressure towards a shutoff position from upstream of the control throttle arrangement, and towards the through flow position from downstream of the control throttle arrangement.

15. The hydraulically operable working tool according to claim 14 wherein the seat and the seat valve closing member with the sealing surface are located between the hydroconsumer and the tank for the shutoff position, wherein the switching valve further comprises a tank connection, and wherein the seat valve closing member is configured to shut off under the delivery pressure or delivery rate of the pressure source at the seat and is, without delivery pressure or delivery rate, configured to be lifted off the seat by the spring force of the switching valve.

16. The hydraulically operable working tool according to claim 14 wherein, in the passage, either the control throttle embodied as a screwed-in throttle insert, and the check valve embodied as a plate-type check valve are mounted, or the spring-loaded check valve with control throttle function is mounted.

17. A hydraulic drive comprising:

a pressure source;

a tank;

at least one single-actuated hydroconsumer that is actuatable from the pressure source to execute an extending motion into a working position counter to a permanent force; and a switching valve having a working force/pressure control function, the switching valve being configured to respond counter to spring force and depending on pressure and/or through flow volume, and the switching valve being operable to take a through flow position when the pressure source is cut off or switched off and to connect an admission chamber of the hydroconsumer at least via a bore with the tank for a return stroke of the hydroconsumer;

wherein the hydroconsumer is stoppable during the return stroke hydraulically via the pressure source by a pressure pulse and/or a through flow volume pulse;

wherein switching valve function of the switching valve and the working force/pressure control function are connected in parallel in a working line extending from the pressure source via the hydroconsumer and the bore to the tank, and a portion of the working line to the hydroconsumer and a portion of the working line from the hydroconsumer to the tank each extend through the switching valve;

wherein the working line comprises, between the pressure source and the hydroconsumer, a control throttle arrangement that is configured to generate a pressure differential from hydraulic delivery pressure or delivery rate generated by the pressure source, the control throttle arrangement comprising either a control throttle and a check valve configured to shut off in a return flow direction to the pressure source, or only a spring-loaded check valve with control throttle function configured to shut off in the return flow direction to the pressure source, and wherein the spring force of the switching valve is configured to act in a moving direction of the switching valve to the through flow position, and the switching valve is configured to be pilot controlled by pressure towards a shutoff position from upstream of the control throttle arrangement, and towards the passage position from downstream of the control throttle arrangement; and wherein the hydraulic drive further comprises a pressure source on-off switch, and either a time function element or a program section that is functionally allocated to the pressure source on-off switch to switch on the pressure source for stopping the return stroke of the hydroconsumer over a predetermined time duration which ensures that the pressure pulse and/or the through flow volume pulse is sufficient for switching the switching valve from the through flow position to the shutoff position and holding the switching valve in the shutoff position via a pressure differential generated at the control throttle arrangement.

18. The hydraulic drive of claim 17 wherein the pressure source comprises a pump, and the pressure source on-off switch comprises a pump on-off switch.

* * * * *